US005411351A

United States Patent [19]

Lasch et al.

[11] Patent Number: 5,411,351

[45] Date of Patent: May 2, 1995

[54] CONFORMING A MICROPOROUS SHEET TO A SOLID SURFACE

[75] Inventors: James E. Lasch, Oakdale; James M. Kaczmarczik, Maplewood; James A. Klein, Minneapolis; James M. Jonza, Shoreview, all of Minn.

[73] Assignee: Minnesota Mining and Manufacturing Company, St. Paul, Minn.

[21] Appl. No.: 894,439

[22] Filed: Jun. 5, 1992

Related U.S. Application Data

[63] Continuation of Ser. No. 721,314, Jun. 26, 1991, Pat. No. 5,120,154, which is a continuation of Ser. No. 398,971, Aug. 28, 1989, Pat. No. 5,082,715.

[51] Int. Cl.[6] ..... B32B 27/00; D02J 3/00

[52] U.S. Cl. ..... 404/14; 264/288.8; 264/289.3; 428/315.5; 428/423.1

[58] Field of Search ..... 404/14; 264/228.8, 289.3, 264/289.6; 428/290, 315.5, 423.1

[56] References Cited

U.S. PATENT DOCUMENTS

| | | | |
|---|---|---|---|
| 3,308,073 | 3/1967 | Kepple . | |
| 3,451,537 | 6/1969 | Freeman et al. | 206/59 |
| 3,954,927 | 5/1976 | Duling | 264/49 |
| 4,117,192 | 9/1978 | Jorgensen | 428/337 |
| 4,248,932 | 2/1981 | Tung et al. | 404/20 X |
| 4,299,874 | 11/1981 | Jones et al. | 428/143 |
| 4,344,908 | 8/1982 | Smith et al. | 264/203 |
| 4,411,854 | 10/1983 | Maurer et al. | 264/205 |
| 4,413,110 | 11/1983 | Kavesh et al. | 526/348.1 |
| 4,430,383 | 2/1984 | Smith et al. | 428/364 |
| 4,443,510 | 4/1984 | Watt | 404/14 X |
| 4,455,273 | 6/1984 | Harpell et al. | 264/184 |
| 4,490,432 | 12/1984 | Jordan | 428/220 |
| 4,519,909 | 5/1985 | Castro | 210/500.2 |
| 4,539,256 | 9/1985 | Shipman | 428/315.5 |
| 4,545,950 | 10/1985 | Motooka et al. | 264/210.6 |
| 4,551,296 | 11/1985 | Kavesh et al. | 264/177 |
| 4,575,278 | 3/1986 | Whitney | 404/72 |
| 4,584,347 | 4/1986 | Harpell et al. | 525/119 |
| 4,613,441 | 9/1986 | Kohno et al. | 210/500.36 |
| 4,617,124 | 10/1986 | Pall et al. | 210/638 |
| 4,648,689 | 3/1987 | May | 404/14 X |
| 4,655,769 | 4/1987 | Zachariades | 623/1 |
| 4,668,717 | 5/1987 | Lemstra et al. | 523/322 |
| 4,699,857 | 10/1987 | Giovannoni et al. | 429/284 |
| 4,726,989 | 2/1988 | Mrozinski | 428/315.5 |
| 4,772,511 | 9/1988 | Wood et al. | 404/93 X |
| 4,778,601 | 10/1988 | Lopatin et al. | 210/500.27 |
| 4,791,144 | 12/1988 | Nagou et al. | 521/90 |
| 4,808,471 | 2/1989 | Grunzinger | 428/325 |
| 4,837,069 | 6/1989 | Bescup et al. | 404/14 X |
| 4,842,596 | 6/1989 | Kielpikowski et al. | 604/393 X |
| 4,867,881 | 9/1989 | Kinzer | 210/490 |
| 4,876,141 | 10/1989 | Kobayashi et al. | 404/14 X |
| 4,945,125 | 7/1990 | Dillon et al. | 264/DIG. 47 X |
| 4,969,713 | 11/1990 | Wyckoff | 404/14 X |
| 4,990,024 | 2/1991 | Eigenmann | 404/12 |
| 5,004,466 | 4/1991 | Uda et al. | 604/391 X |
| 5,019,065 | 5/1991 | Scripps | 604/391 X |
| 5,071,609 | 12/1991 | Tu et al. | 264/289.3 X |

FOREIGN PATENT DOCUMENTS

| | | |
|---|---|---|
| 0135253 | 3/1985 | European Pat. Off. . |
| 0162229 | 11/1985 | European Pat. Off. . |
| 0167187 | 1/1986 | European Pat. Off. . |
| 0168923 | 1/1986 | European Pat. Off. . |
| 0190878 | 8/1986 | European Pat. Off. . |
| WO86/02282 | 4/1986 | WIPO . |

*Primary Examiner*—Ramon S. Britts
*Assistant Examiner*—Roger J. Schoeppel
*Attorney, Agent, or Firm*—Gary L. Griswold; Walter N. Kirn; Steven E. Skolnick

[57] ABSTRACT

Conformable marking sheet comprising a microporous thermoplastic polymer base sheet having a network of interconnected pores. The marking sheet has a low yield stress, making it conformable to rough surfaces. The pores of the base sheet can be filled with a diluent (wax) or they may have the diluent removed, for example by extraction. The construction may further comprise an adhesive on the bottom and a top marking indicium layer comprising a polymeric binder in which is partially embedded a multiplicity of retroflective lens elements, e.g., transparent microspheres.

20 Claims, 2 Drawing Sheets

CONFORMING A MICROPOROUS SHEET TO A SOLID SURFACE

CROSS-REFERENCE TO RELATED APPLICATIONS

This is a continuation of patent application Ser. No. 07/721,314 filed Jun. 26, 1991, now U.S. Pat. No. 5,120,154, which is a continuation of patent application Ser. No. 07/398,971 filed Aug. 28, 1989, now U.S. Pat. No. 5,082,715.

TECHNICAL FIELD

This invention is in the field of polymeric sheeting, specifically sheeting used to mark surfaces such as highways and streets. It also relates to microporous polymeric sheeting and its application where conformability is important.

BACKGROUND

The use of various types of polymeric sheeting products to mark surfaces such as streets (e.g. cross walk markings and lane-stripes) has been known for years. Such sheeting has advantages over painted lines. It has a potentially longer life and more and better ways exist to reflectorize it.

However, a number of problems have hindered the broader acceptance of polymeric sheet pavement markers. One of these problems is that in high traffic areas or in climates which undergo large variations in temperature, sheeting can become loosened from the substrate surface prematurely, i.e. before it is actually worn out.

The actual mode of failure and failure point can vary. The adhesive can fail. The elastic nature of the sheet can create stresses within the sheeting structure that (even after the application of good adhesive and tamping) can cause the sheet to recover its original shape (i.e. its shape before tamping it down onto the road) leaving insufficient contact area for good adhesion to the road. Water and dirt can also lodge between the road and sheet, and, with the action of freezing and thawing and other environmental factors, can further reduce the adhesion of the sheeting to the road.

A sheet which is softer (or more easily conformable) and less elastic is useful in improving adhesion of the sheeting to a substrate. The prior art of inelastically conformable materials includes many materials which lack structural integrity. They conform by being crushed (some plastic foams), by cold flow (waxes and putty), or by other mechanisms which imply lack of strength. Some conformable materials in the prior art are aluminum foil and rubbery polymers of low glass transition temperatures which have not been cross-linked.

Another problem is the actual wear of the sheet by attrition from road dirt and the action of vehicle tires traversing it. Thus, a sheeting which has improved wear properties, ease of conformability, inelasticity, high tensile and tear strength, and low temperature applicability is desired.

DISCLOSURE OF INVENTION

The invention is summarized as a conformable marking sheet, having a top surface and a bottom surface, comprising a base sheet comprising microporous thermoplastic polymer, which marking sheet is characterized by exhibiting, when tested using standard tensile strength testing apparatus, at least 25% inelastic deformation (ID) after being stretched once to 115% of the original sample length. In a broader sense, one can use a base sheet characterized by at least 25% (ID) after being stretched to 115% of its original length in sheet constructions, although the whole construction may exhibit less ID. The top surface is useful as a marking indicium, for example, by being colored or reflectorized.

The sheet Just described may be considered a base sheet, and there can be adhered to the base sheet a polymeric layer useful as a marking indicium or said resistant means on surfaces. Suitable material for the polymeric layer may be either thermoplastic or thermosetting polymeric binder.

The term inelastic deformation as used herein will be described later in this specification.

One application of the invention is for pavement markings, especially removable ones, such as are used in construction work zones. Construction work zone marking tape requires high tensile and tear strengths to allow it to be removed after a construction project is finished. Without sufficient strength, it may fall apart making removal difficult.

The remainder of this specification will discuss the invention in terms of pavement marking sheeting or strips, since the research and development which led to the invention has been in the pavement marking field. However, the invention is not actually limited to that field, and it is to be understood that such sheeting can be applied to many different types of solid surfaces, such as stairways, floors in warehouses or stores. The inventive sheeting can be used generally for applications requiring markings which are supposed to be conformable to the surface on which they are applied, especially at low temperatures. Reflective elements and skid resistant particles can be attached to the sheeting by various means, and a variety of adhesives can be used to bond the sheeting to road and other surfaces.

Several embodiments of the invention are:

1. a base sheet adhered to a road with adhesive (e.g., pressure sensitive adhesive (PSA)) and having a multiplicity of retroreflective lens elements (e.g. microspheres) embedded in the base sheet at or near the surface;
2. bead bond—comprising a multiplicity of retroreflective microspheres held in a bead bond layer which is on top of the base sheet which in turn has a coating of PSA on the bottoms and
3. Adhesive-bonded topcoat—comprising a construction like 2. above, but in which the bead bond layer is held on to the base sheet by an adhesive.

The inventive marking sheet provides a unique combination of mechanical properties not found in typical pavement marking tapes:

A. combination of good drape and plastic deformation at low stress and strain (inelastic conformability) for conformance to a surface;
B. high tensile and tear strengths for removability;
C. abrasion resistances;
D. high moisture vapor transmission for better aged adhesion in wet environments (except when the pores are filled as taught hereinafter);
E. one base film able to provide all required tape mechanical properties (as opposed to multilayer composites of reinforcing scrims together with polymer film and possibly foam and adhesive layers) resulting in potentially lower manufacturing costs; and F. low temperature conformability.

Inelastic conformability has not yet been recognized in the literature as a property of microporous materials. Yet, this invention takes advantage of that property. The base sheet material requires no drawing or other orientation to exhibit useful properties, although an orientation step is not precluded. The diluent used in making the base sheet material need not be removed from the final product. Conformability can be manifested regardless of whether or not the diluent remains, provided an appropriate diluent is selected.

If an idea rubber were used in a pavement marking sheeting, it would retract entirely from depressions in the pavement into which it was tamped, while a completely inelastic material would have no retraction (or retractive force). The materials of this invention have a unique combination of low force to deform, permanence of said deformation, and high break strength and tear strength.

DETAILED DESCRIPTION

Figure 1:
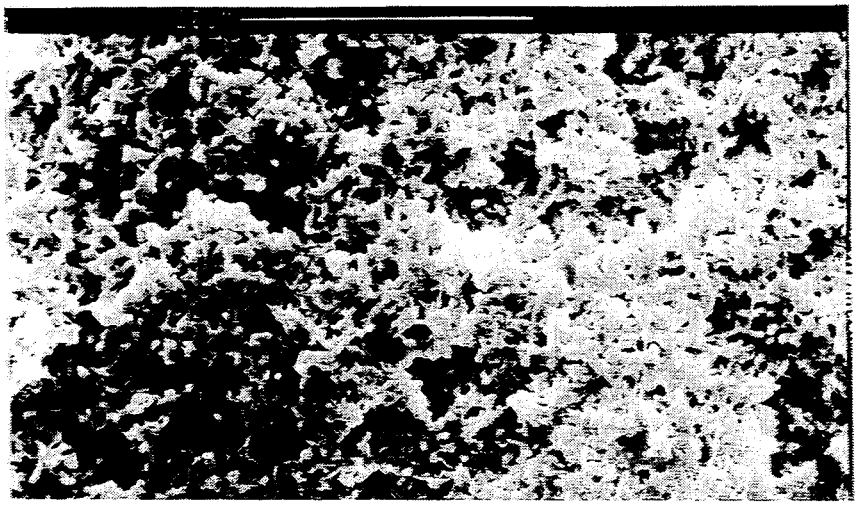
FIG. 1 is a scanning electron microscope (SEM) photomicrograph at 200× of a microporous base sheet according to this invention, made of high density polyethylene and mineral oil diluent. Some of the mineral oil remains in the sheet.
Figure 2:
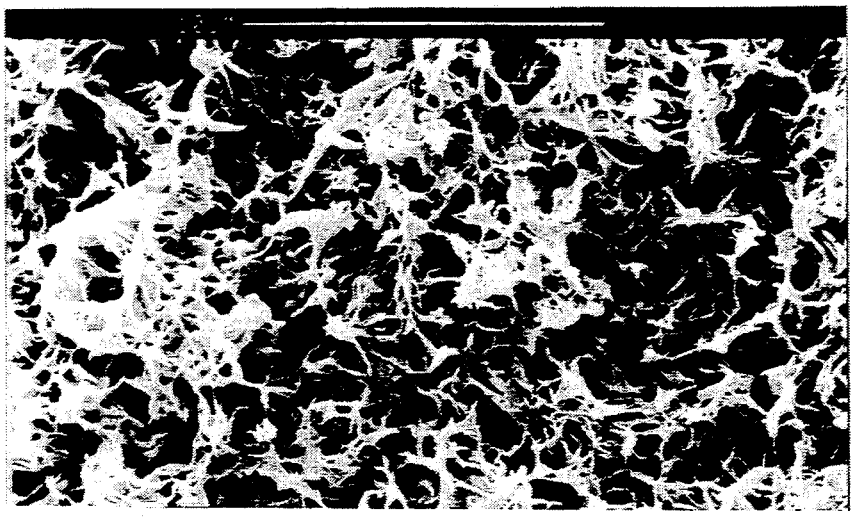
FIG. 2 is an SEM photomicrograph (490×) of a microporous base sheet of this invention, made of high density polyethylene having the diluent extracted out, leaving air in the pores or void spaces.

As used herein, the term thermoplastic polymer refers to conventional polymers, both crystalline and non-crystalline, which are processable under ordinary melt conditions, and ultra high molecular weight grades of such polymers, which are ordinarily not thought to be melt processable. The term melting temperature refers to the temperature at which a crystalline thermoplastic polymer, in a blend with compatible liquid, will melt.

The term microporous means having diluent phase or a gas such as air throughout the material in pores or voids of microscopic size (i.e., visible under a microscope but not with the naked eye). Although the pores need not be interconnected they can be. Typical pore size in the base sheet of the inventive marking sheet is in the range of 100 Angstroms to 4 micrometer.

The term crystalline, as applied herein to thermoplastic polymers, includes polymers which are at least partially crystalline or semicrystalline. Crystallizable polymers are those which, upon cooling from a melt under controlled conditions, spontaneously form geometrically regular and ordered chemical structures, and crystalline polymers are those which have such structures, indicated by x-ray diffraction analysis and a distinct peak in differential scanning calorimeter (DSC) analysis. Crystallization temperature means the temperature at which a polymer in a melt blend of thermoplastic polymer and compatible liquid will crystallize.

The term solid diluent means a material which is a solvent in the process of making the microporous polymer but which is solid at room temperature, about 24° C. Such solid diluents may remain in the finished base sheet.

A gel is a material comprising a dispersed component (the thermoplastic polymer in the case of this description) being a high molecular weight polymer, and a dispersive medium (the solvent or diluent) being, on average, of lower molecular weight. Both components are geometrically continuous throughout the volume of the material, the polymer phase forming a three-dimensional continuous network; while, the diluent fills the remaining volume within the network. Gels exhibit mechanical properties characteristic of solids and uncharacteristic of liquids: measurable modulus of elasticity, which is usually quite low for the polymer in question; and a relatively low yield stress.

Thermoplastic polymers useful in the invention include polyamides, polyesters, polyurethanes, polycarbonates, polyolefins, diene-containing polymers, poly(vinylidene fluoride), poly(tetrafluoroethylene), and polyvinyl-containing polymers. Representative polyolefins include high and low density polyethylene, ethylene-propylene-diene terpolymers, polypropylene, polybutylene, ethylene copolymers, and polymethylpentene. Polyethylene is here understood to mean any polymer of ethylene which may also contain minor amounts (e.g., no more than 5 mole percent) of one or more other alkenes copolymerized therewith, such as propylene, butylene, pentene, hexene, 4-methylpentene and octene. Blends of thermoplastic polymers may also be used. HMWPE (high molecular weight polyethylene), for purposes of this description, has a molecular weight of 100,000 to 1,000,000 preferably 200,000 to 500,000. UHMWPE (ultra-high molecular weight polyethylene) has a molecular weight of at least 500,000, preferably at least 1,000,000.

The thermoplastic polymer may include blended therein certain conventional additive materials in limited quantity in order not to interfere with formation of the microporous base sheet. Such additives may include dyes, plasticizers, ultraviolet radiation stabilizers, fillers and nucleating agents. Fillers in polymers are known generally, and some examples are: silicates (such as clay, talcum or mica); or oxides (such as $Al_2O_3$, MgO, silica or $TiO_2$).

Nucleating agents, in accordance with U.S. Pat. No. 4,726,989, the disclosure of which is incorporated herein by reference, may be used as a raw material. Examples of nucleating agents are dibenzylidine sorbitol, titanium dioxide, adipic acid, and benzoic acid.

In making the porous base sheet, the thermoplastic polymer is blended with a compatible organic diluent, i.e. a diluent which will not degrade the polymer and with which the thermoplastic polymer is at least partially miscible. The diluent will dissolve at least a substantial fraction of the polymer at the melt processing temperature of the thermoplastic polymer, but will phase separate from the polymer on cooling to a temperature below the melting or crystallization temperature. The diluents may be normally liquids or solids at room conditions.

The liquid diluents preferably have a relatively high boiling point at atmospheric pressure, at least as high as the melt processing temperature of the thermoplastic polymer, preferably at least 20° C. higher. The compatibility of a liquid diluent with a given thermoplastic polymer can be determined by heating the polymer and the liquid diluent to form a clear, homogeneous solution. If such a solution cannot be formed at any concentration, then the liquid is not compatible with the polymer. For non-polar polymers, non-polar organic liquids with similar room temperature solubility parameters are generally useful. Polar organic liquids are generally useful with polar polymers. Some useful diluents with polyolefins are: aliphatic or aromatic hydrocarbons such as toluene, xylene, naphthalene, butylbenzene, p-cymene, diethylbenzene, pentylbenzene, monochlorobenzene, nonane, decane, undecane, dodecane, kerosene, tetralin, or decalin.

Some representative blends of thermoplastic polymer and liquid diluent useful in preparing the microporous thermoplastic polymer are mixtures of: polypropylene and mineral oil, dibenzyl ether, dibutyl phthalate, dioctylphthalate or mineral spirits; polyethylene and xylene, decalin, decanoic acid, oleic acid, decyl alcohol, mineral oil or mineral spirits; polypropylene-polyethylene copolymer and mineral oil; polyethylene and diethylphthalate, dioctyl phthalate or methyl nonyl ketone.

The relative amounts of thermoplastic polymer and diluent vary with each system. The blend of thermoplastic polymer and diluent can comprise about 1 to 75 weight percent thermoplastic polymer. For HMWPE, it is preferred to use 20–65% (preferably 30–50%) polymer in the diluent, and for UHMWPE, it is preferred to use less than 30% polymer, preferably less than 20%. The nucleating agent may be present in a proportion of 0.1 to 5 parts by weight per 100 parts of polymer.

Generally, solid diluents may be selected from any material (meeting the definition of solid solvent and the criteria for diluents above) with which the thermoplastic polymer is compatible at elevated temperature. If the solid solvent is to remain in the base sheet, it should be flexible and deformable when cast as a film or sheet at room temperature. For polyethylene, such materials may include, but are not limited to, low molecular weight polymers and resins; i.e., having a molecular weight low enough so that the polymeric diluent is substantially miscible with a melt of the polyethylene.

Exemplary of useful solid solvents are petroleum microcrystalline waxes or synthetic waxes. The physical properties of a wax used as a solid solvent have a substantial impact on the conformability of the resulting gel film. Brittle waxes yield brittle gels, firm waxes yield firm films, and soft, deformable waxes yield conformable films.

Microcrystalline waxes generally have a higher molecular weight than normal paraffin waxes, the carbon number ranging from the thirties to upper eighties. Branched hydrocarbons predominate in microcrystalline waxes, the degree of branching typically ranging from 70 to 100 percent. Polymeric diluents may be used for polyethylene and may be blended with nonpolymeric diluents.

In pavement marking applications, the material of construction should be able to withstand temperatures in excess of 60° C. on black asphalt pavement on hot summer days. Wax-based gels have been prone to develop a liquid exudation of some component of the wax at such temperatures. A preferred wax for the combination of gel conformability and high temperature behavior has been Allied AC1702, a synthetic polyethylene wax supplied by Allied Chemical Company. At elevated temperature, however, gels containing this wax still exude the soft wax itself. Addition of a polymeric component such as EPDM rubber to the diluent can alleviate this problem.

There are several ways to make the microporous base sheet. One type of process can be called thermally induced microporous phase separation, of which there are two types: one represented by U.S. Pat. No. 4,539,256 (Shipman) in which phase separation depends on crystallization of the thermoplastic polymer; and one represented by U.S. Pat. No. 4,519,909 (Castro) in which phase separation depends on solubility differences between the polymer and diluent at different temperatures. The disclosure of U.S. Pat. No. 4,539,256 at Column 2, line 50—Column 3, line 12 and at Column 6, line 27—Column 7, line 39 is incorporated by reference herein.

A second type of process may be called geltrusion or the gel process. In general, the thermoplastic polymer (typically one of unusually high molecular weight which is difficult to process by conventional melt processes) is rendered microporous by first heating it together with the diluent (e.g., mineral oil) to a temperature and for a time sufficient to form a solution (with lower viscosity than the pure polymer melt). The solution is formed into a desired shape (e.g., by extrusion) and is then cooled (below the crystallization or melting temperature) in said shape at a rate and to a temperature sufficient so that phase separation occurs between the diluent and polymer (e.g., by quenching at the discharge of an extruder).

Unlike precipitation from a dilute solution, in the gel process a residual degree of molecular entanglement ties the polymer crystallites (in the case of crystallizable polymers) together into a gel, in which the diluent is loosely held. If quenching or cooling is rapid enough, the degree of entanglement in the solution is preserved in the gel as it solidifies. The cooling is continued until a solid results.

A portion or all of the diluent may be removed (e.g., by extraction, compression or evaporation) from the solid. Microporous thermoplastic sheets with the diluent extracted will be advantageous in applications in which porosity is desired or in which the film is to be easily compressible or reduced in thickness.

More detail will now be given about the processes, first using liquid diluent and then using solid diluent. The thermally induced microporous phase separation involving liquid diluent can proceed by the following steps:

1. Polypropylene pellets are metered by weight to the feed end of a corotating twin screw extruder having temperature control means (such as heating-/cooling jacket, which may be divided into various zones along the extruder barrel) and operated under conditions to reduce the pellets to a viscous melt at a temperature usually about 25°–100° C. above the melting temperature of the polymer.
2. Near the feed end of the extruder, mineral oil diluent is pumped into the polypropylene melt inside the extruder, and the resulting mixture is further mixed and transported down the barrel of the extruder.
3. A gear pump transfers the mixture through a filter to a film die having a slit appropriate for obtaining the desired base film thickness. The film die is located above a water quench bath (maintained at a suitable temperature, eg. below crystallization temperature for crystallizable polymers) which may be of conventional design for film extrusion operations. In the quench bath, the microporosity forms in the extruded film with pores open to both sides. In the quench bath, the film has sufficient strength for further processing, for example, by means of guides and rollers. Alternatively, if the film die directs the film extrudate onto a casting drum or chill roll (e.g. rotating stainless steel drum cooled with water) a skin can form on a surface of the film which may leave pores open only on one side (see U.S. Pat. No. 4,539,256 Example 13 which is incorporated herein by reference).

4. The cooled film is transported through a solvent extraction or leaching process containing an effective extractant for the solvent in the pores of the film, for example 1,1,1-trichloroethane as an extractant to remove the mineral oil solvent.
5. The film with solvent extracted from its pores is then dried.
6. Optionally, the microporous thermoplastic polymer film may be drawn or oriented in both the machine direction and the transverse direction to give higher porosity and strength. Stretching or draw ratio is usually low, typically 50% stretch or less. Suitable stretching temperatures are known in the art or are readily determinable. Stretch is preferably not so much as to reduce the base sheet tear strength below usable limits for removable tapes.

In the case of the gel process using UHMWPE, a typical small scale solution preparation uses an 8 liter mixing vessel having two intermeshing double helical blade agitators (Helicone mixer, model 8CV), 4.54 kg. diluent, sufficient UHMWPE to comprise 10% of the total, and 0.5% by weight (based on total weight) of antioxidant (eg. di-t-butyl -p-cresol). Half the diluent and half the antioxidant are added to the mixer and heated, stirring under nitrogen atmosphere to 180°-200° C. The remaining diluent and antioxidant are melted in a separate vessel and held at a temperature of 120° C. or less. The UHMWPE powder is added to the separate vessel, stirring to form a uniform slurry or suspension. With the Helicone mixer at maximum rotational speed, the suspension is added to the hot diluent. The mixture quickly rises in viscosity, and the mixer speed is reduced to the minimum. The mixture is stirred slowly, at 180°-200° C., under nitrogen atmosphere until it is homogeneous (typically between one and four hours). The mixing vessel is then evacuated to degas the solution, and it is pressurized to collapse any foam. The solution can then be discharged using a metering pump and cooled. It can then be skived or melt pressed into sheets.

Further information on processing UHMWPE is in U.S. Pat. No. 4,413,110, Column 7, line 50—Column 8, line 12 and U.S. Pat. No. 3,954,927, Column 4, lines 47-59 which portions are incorporated by reference herein.

The gel process using solid diluents is essentially like that described above, except that the slurry is made above the melting point of the solid diluent and below the polymer melting temperature. The gel process may also proceed by preparing a slurry and feeding it to a twin screw extruder. Further teaching on this process for UHMWPE diluent systems can be found in U.S. Pat. No. 4,778,601. Extrusion of the pure UHMWPE for even a short section of the extruder prior to diluent mixing can lead to polymer degradation, lowering molecular weight. The remainder of the process can be like steps 3-6 above. The extraction step (4) can be deleted, leaving the solid diluent in the pores. It is not always necessary to dry the film. The base sheet film can be wound up on cores with or without a release liner.

Addition of unvulcanized copolymer rubbers to wax diluents to form mixed diluents has resulted in materials with decreased high temperature exudation. This was demonstrated for a 1% UHMWPE gel in a mixture of 95% microcrystalline wax and 5% Elvax 46 ethylene-vinyl acetate copolymer (by DuPont). Several 10% UHMWPE gels have been made in such mixed diluents containing up to 20% of a variety of copolymer rubbers. One useful embodiment utilized 10% UHMWPE in a 80/20 ratio mixture of soft, synthetic wax (Allied AC1702) and EPsyn E901 EPDM (ethylene propylene diene) rubber (by Copolymer Corp.).

When extraction is used, examples of useful extraction solvents are hydrocarbons, chlorinated hydrocarbons and oxygenated solvents, such as pentane, hexane, heptane, methylene chloride and diethyl ether. Further information on the extraction step is in U.S. Pat. No 4,413,110 at Column 5, lines 12-30 and Column 8, line 61—Column 9, line 6, and U.S. Pat. No. 3,954,927 at Column 3, line 64—Column 4, line 10 which portions are incorporated by reference herein.

The microporous films made by the processes described above with the extraction step have a structure that enables fluids to flow through them.

Certain of these microporous films can be characterized by having a multiplicity of spaced, randomly dispersed, non-uniform microscopic masses of crystallizable thermoplastic polymer interconnected by fibrils of the thermoplastic polymer. The microporous films can also be described as a thermoplastic film having a multiplicity of cells, adjacent cells being connected to form a network of communicating pores. The cells comprise voids encased by fibrous, lacy or semi-continuous boundaries. There may also be a gradient in the porosity of the film.

Conformability of the porous films can be evaluated in several ways. One simple way is to press the material by hand against a complex, rough or textured surface, such as a concrete block or asphalt composite pavement, remove, and observe the degree to which surface roughness and features are replicated in the film. The base films of this invention will conform to complex shapes and rough surfaces. Elastic recovery can be gauged by observing the tendency of the replicated roughness to disappear over time. A simpler test is to use a blunt instrument to indent the film. The ease with which the impression can be made and the permanence of the impression can be used to form rough comparative judgments of the film.

A more quantitative test for conformability is made in the following sequence: 1. A test strip (standard strip size for tensile strength testing) is pulled in a tensile strength apparatus (at, for example, a rate of 300%/minute) until it has stretched some predetermined amount, e.g. 15%. 2. The deformation is reversed, causing a decrease in tensile stress to zero. 3. On repeated tensile deformation, no force is observed until the sample is again taut. 4. The strain at which force is first observed on a second pull is a measure of how much of the first deformation was permanent. 5. This strain divided by the first (e.g., 15%) deformation is defined as the inelastic deformation (ID). A perfectly elastic material or rubber would have 0% ID, i.e., it would return to its original length. Metals approach 90% ID, but require high tensile yield stresses. Conformable materials of this invention combine low stress of deformation and ID greater than 25%, preferably greater than 35%, more preferably greater than 50%.

Preferably, the force required to achieve 15% strain in the base sheet (initial thickness typically about 300 micrometers) is less than 28 lbs. per inch of sample width (50 Newtons/cm of sample width), more preferably less than 10 lbs./in. (17.5 N/cm). For a complete pavement marking sheet as described hereinafter (initial thickness typically about 600 micrometers), comprising for example a polyurethane top layer, a porous thermoplastic base sheet, and an adhesive, the force required to achieve 15% strain is less than 150 lbs./in. of sample width (263 Newtons/cm of width). Force per unit of width is a common way to measure stress in tape samples.

Pavement marking sheet material may be described as a prefabricated web or strip adapted to be laid on and secured to pavement for such purposes as lane dividing lines and comprises:

A. a base sheet; and

B. a layer of reflective elements and/or skid resistant particles.

Pavement marking sheeting can include an adhesive (e.g. pressure sensitive, heat or solvent activated, or contact bond adhesive) on the bottom of the base sheet. It may also include a top layer (also called the support film, bead bond or binder film) adhered to one surface of the base sheet and being flexible and resistant to rupture (e.g. vinyl polymers, polyurethanes, epoxies, polyesters and ethylene copolymers such as ethylene vinyl acetate, ethylene methacrylic acid, and ethylene acrylic acid copolymers). Transparent microspheres (for retroreflectivity) and/or skid resistant particles can be embedded in the top layer.

Pavement marking sheets are described in U.S. Pat. Nos. 4,117,192, 4,248,932, and 4,490,432 the disclosures of which are incorporated by reference herein. The base sheet is usually at least 0.05 mm. thick but less than 3 mm. thick.

A representative marking sheet of this invention comprises, going from the top down:

1. vinyl top layer bonded with PSA such as a silicone PSA (e.g. Dow Corning Q2 7406) typically 75 micrometers thick, to;
2. a porous thermoplastic base sheet as described hereinabove;
3. bottom PSA, such as solvent based PSA (rubber/resin PSA comprising natural or synthetic rubber plus a tackifying resin or silicone PSA in hexane solvent) coated on the bottom of the porous thermoplastic base sheet typically 50–150 micrometers thick; and
4. silicone coated release liner covering the bottom PSA.

A useful PSA for the bottom of the conformable marking sheet is described in U.S. Pat. No. 3,451,537, Example 5.

This marking can be made by:

1. bonding the bottom of the porous thermoplastic base sheet to the bottom PSA (furnished on the silicone coated release liner) by laminating them between pressure rolls;
2. bonding the top of the porous thermoplastic base sheet to a PSA with a release liner on the side of said PSA opposite the base sheet by the same method as in step 1;
3. peeling off the release liner on top of the composite from step 2, exposing the PSA; and
4. applying the bottom of the top layer, furnished as a film having embedded therein transparent microspheres, to the PSA exposed in step 3 and pressing it down with a pressure wheel or roller.

The top coat can be made by coating onto a silicone coated release liner a mixture of resin, pigment (e.g., $TiO_2$ or lead chromate) and solvent (e.g., methylethylketone); dropping onto the wet surface of the resulting resin mixture a multiplicity of transparent microspheres (e.g., made of glass or non-vitreous ceramic) and skid resistant particles; and curing the resin to hold the microspheres firmly, partially embedded in the resin film.

The curing step employed depends on the nature of the resin. For polyurethane polymers, curing may be thermal by elevating the temperature in an oven or dryer, moisture activated (using a moisture activated curing agent and a polyisocyanate prepolymer), or (in the case of polyurethanes having acrylate or other radiation sensitive ligands) by exposure to radiation (e.g., electron beam). Polyurethane binders for retroreflective elements or skid resistant particles in marking sheeting are known in the art. As an alternative to a cured top coat resin, one could use a thermoplastic resin and solidify it by cooling it.

One of the most significant benefits of the inventive marking sheet is good mechanical properties for low temperature application. This is shown in the following example.

EXAMPLE I

A high profile surface, comprising a multiplicity of glass balls about one cm. in diameter bonded to a metal plate, was prepared to test conformability. Two marking sheet samples were obtained: one control sample which was a commercially available temporary pavement marking tape for construction work zones; and one sample of the inventive marking sheet having a microporous, thermoplastic base sheet. Both were coated on the bottom with a PSA used in adhering such markings to road surfaces. Both samples were placed on pieces of the Just described high profile surface and then were placed in a freezer at −18° C. The samples were equilibrated at that temperature, removed from the freezer, and immediately tamped onto the high profile surface.

Tamping was done by rolling a tamping tool over the sample marking sheets. The tamping tool consisted of a cart frame having a handle and a load bearing portion which cart frame rolled freely on a silicone rubber roller about 75 mm in diameter and 200 mm long. A weight of about 90 kg was on the load bearing portion above the roller, in order to apply force to the roller.

The inventive marking sheet had excellent conformance to the surface and formed a good, retained pond. The control cracked over each glass ball, provided virtually no adhesive contact for adhesion (zero extension and wrap over the glass balls), and seconds after tamping, it literally lifted itself off of the high profile surface.

What is claimed is:

1. A method of conforming a double layer construction to a solid surface, the method comprising the steps of:

a) providing a conformable base sheet comprising a microporous thermoplastic polymer, a sample of which has an inelastic deformation of at least 25% after having been stretched once to 115% of its original length;

b) bonding a layer of material to the conformable base sheet so as to provide the double layer construction; and c) conformably applying the base sheet of the double layer construction to the solid surface.

2. A method according to claim 1 wherein the layer of material is selected from the group consisting of thermoplastic polymers and thermosetting polymers.

3. A method according to claim 1 wherein the layer of material is selected from the group consisting of vinyl polymers, polyurethanes, epoxies, polyesters and ethylene copolymers.

4. A method according to claim 1 wherein the layer of material is adhesively bonded to the base sheet.

5. A method according to claim 1 wherein the base sheet includes a multiplicity of pores having an effective pore size in the range of from 100 Angstroms to 4 micrometers.

6. A method according to claim 1 wherein the thermoplastic polymer of the base sheet is selected from the group consisting of polyethylene, polypropylene, polybutylene, ethylene copolymers, ethylene-propylene-diene terpolymers, polymethylpentene, polyvinylidene fluoride, polytetrafluoroethylene, polyvinyl-containing polymers, polyamides, polyesters, polyurethanes, polycarbonates, and blends thereof.

7. A method according to claim 6 wherein the thermoplastic polymer of the base sheet is high molecular weight polyethylene or ultra high molecular weight polyethylene.

8. A method according to claim 1 wherein the pores of the thermoplastic polymer of the base sheet are at least partially filled With a diluent selected from the group consisting of polymers and resins that are substantially miscible with a melt of the thermoplastic polymer.

9. A method according to claim 8 wherein the diluent is a petroleum microcrystalline wax or a synthetic wax.

10. A method according to claim 8 wherein the thermoplastic polymer of the base sheet comprises from 1 to 75 weight percent of the total of the thermoplastic polymer and the diluent in the base sheet.

11. A method according to claim 1 wherein the thermoplastic polymer of the base sheet is high molecular weight polyethylene the pores of which are at least partially filled with a diluent selected from the group consisting of petroleum microcrystalline waxes and synthetic waxes and further wherein the thermoplastic polymer provides from 20 to 65 weight % of the combined weight of the thermoplastic polymer and the diluent.

12. A method according to claim 1 wherein the thermoplastic polymer of the base sheet is ultra high molecular weight polyethylene the pores of which are at least partially filled with a diluent selected from the group consisting of petroleum microcrystalline waxes and synthetic waxes and further wherein the thermoplastic polymer provides less than 30 weight % of the combined weight of the thermoplastic polymer and the diluent.

13. A method according to claim 1 wherein the base sheet is oriented.

14. A method according to claim 1 wherein the solid surface has a complex, rough or textured finish.

15. A method according to claim 1 wherein the base sheet is adhesively bonded to the solid surface.

16. A method according to claim 1 wherein the solid surface is a hard, rigid solid surface.

17. A method according to claim 16 wherein the hard, rigid solid surface has a complex, rough or textured finish.

18. A method according to claim 17 wherein the solid surface is concrete or asphalt.

19. A method according to claim 16 wherein the thermoplastic polymer of the base sheet is high molecular weight polyethylene the pores of which are at least partially filled with a diluent selected from the group consisting of petroleum microcrystalline waxes and synthetic waxes and further wherein the thermoplastic polymer provides from 20 to 65 weight % of the combined weight of the thermoplastic polymer and the diluent.

20. A method according to claim 16 wherein the thermoplastic polymer of the base sheet is ultra high molecular weight polyethylene the pores of which are at least partially filled with a diluent selected from the group consisting of petroleum microcrystalline waxes and synthetic waxes and further wherein the thermoplastic polymer provides less than 30 weight % of the combined weight of the thermoplastic polymer and the diluent.

* * * * *